United States Patent [19]

Mercer

[11] 4,449,879

[45] May 22, 1984

[54] DRY WALL LIFT

[75] Inventor: James E. Mercer, Dallas, Tex.

[73] Assignee: Henry A. McAdams, Dallas, Tex. ; a part interest

[21] Appl. No.: 360,369

[22] Filed: Mar. 22, 1982

[51] Int. Cl.[3] ..... E04F 21/18

[52] U.S. Cl. ..... 414/11; 211/2; 414/912

[58] Field of Search ..... 414/11, 912; 211/2; 312/237, 240, 241

[56] References Cited

U.S. PATENT DOCUMENTS

| | | | |
|---|---|---|---|
| 1,582,147 | 4/1926 | Stanley | 414/11 |
| 2,371,561 | 3/1945 | Van Patten | 414/11 |
| 2,741,514 | 4/1956 | Fisher | 414/11 |
| 2,789,869 | 4/1957 | Hammagren | 414/11 |
| 3,047,165 | 7/1962 | Hutchinson | 414/11 |
| 3,642,150 | 2/1972 | Zizak | 414/11 |
| 3,910,421 | 10/1975 | Panneton | 414/11 |
| 4,064,999 | 12/1977 | Young | 414/11 |
| 4,280,744 | 7/1981 | Nakano | 312/240 |

*Primary Examiner*—Robert J. Spar

*Assistant Examiner*—Ken Muncy

*Attorney, Agent, or Firm*—Richards, Harris & Medlock

[57] ABSTRACT

A dry wall panel lift is provided in which a vertical support has spaced apart legs of about ceiling height and at least two crossbars, one at full height and one at worktable height.

A work frame has a pivotal detachable connection at one end to one of the crossbars and legs of worktable height at the other end extending away from the work surface of the frame.

A stiff leg is pivotally connected to the end of the work frame opposite the connection and is of length about equal ceiling height.

A work stop extends across the work frame in the region remote from the connection. When one end of the work frame is lowered to slope downwardly from the connection, the stop will restrain a ceiling panel on the work frame preparatory to elevating the panel to ceiling height. The work frame can be connected to either of the bars for selectively functioning as a ceiling panel lift or for a worktable support.

1 Claim, 3 Drawing Figures

DRY WALL LIFT

TECHNICAL FIELD

This invention relates to a device for lifting and positioning dry wall sheets during the installation of ceiling sections.

BACKGROUND ART

Dry wall lifts and the like have been heretofore provided as an aid in positioning and supporting a sheet of dry wall during installation of ceiling portions. However, the dry wall lifts found in the prior art are relatively bulky and cumbersome which makes them difficult to store, to transport or even to move from one room to the next. Moreover, the dry wall lifts found in the prior art are of limited use in that their only function is to lift and support the dry wall during the installation of ceiling portions. While installing dry wall, however, a convenient horizontal working surface is often essential.

Accordingly, there is a need for a dry wall lift which is convenient in transportation and storage, and which can be readily transformed into a horizontal working surface.

DISCLOSURE OF THE INVENTION

In accordance with the present invention, a dry wall panel lift is provided that includes a vertical support. A work frame is pivotally coupled at one end to the upper portion of the vertical support for supporting a sheet of dry wall material. The work frame has work height legs at the end thereof opposite the vertical support. The vertical support is provided with telescoping sections to allow vertical height adjustment of the vertical support so that the upper end thereof extends to approximately the same height as the ceiling of the room in which the dry wall is to be installed. A sheet of dry wall is placed on the frame while one end of the work frame is in a lowered position. The work frame is then rotated upwardly until the dry wall sheet is positioned adjacent to the ceiling joists. Hingedly coupled to the free end of the work frame is a telecoping, stabilizing pole which supports the end of the work frame opposite the vertical support once the dry wall is raised to ceiling level. This enables the installer to nail the dry wall to the ceiling joists without having to physically sustain the weight of the dry wall.

The present invention also provides for the work frame to be uncoupled from the upper portion of the vertical support and re-attached to the vertical support at a lower work height location so as to provide a horizontal panel supporting surface.

The dry wall lift of the present invention is easily disassembled for ease and convenience in storage and transportation.

DESCRIPTION OF THE DRAWINGS

The present invention can be more completely understood by reference to the following description taken in conjunction with the accompanying drawings in which.

DETAILED DESCRIPTION

In accordance with the present invention, a dry wall lift is provided for use by dry wall (sheetrock) installers to simplify the placement and holding of sections of dry wall panels overhead during the installation of ceiling sections.

Figure 1:
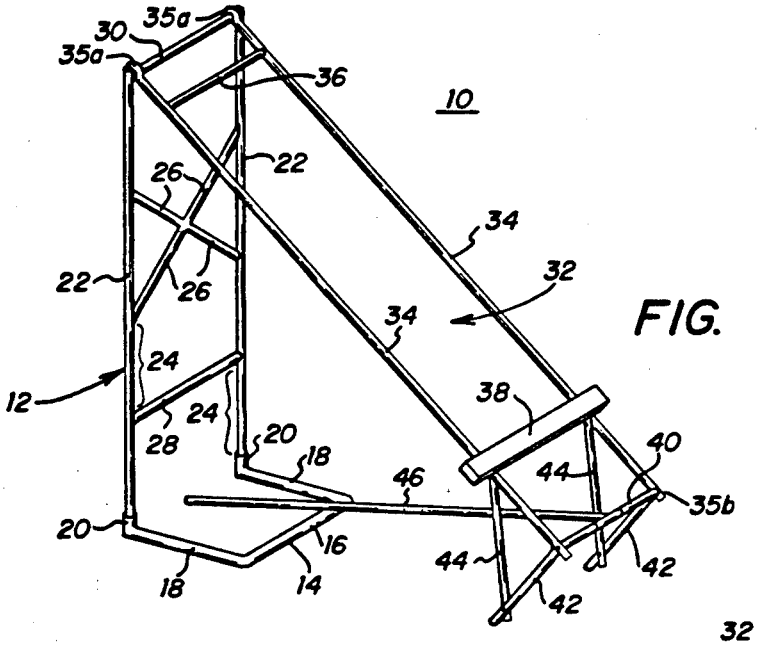
FIG. 1 is a perspective view.
Figure 2:
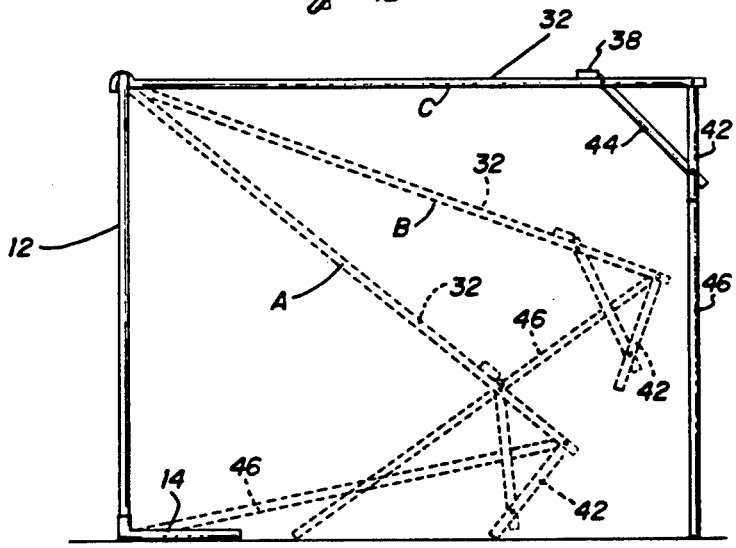
FIG. 2 is a side elevation view.
Figure 3:
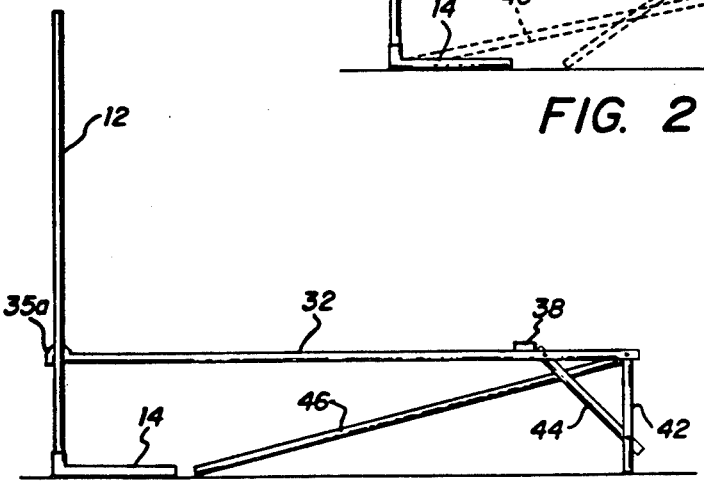
FIG. 3 is a side elevation view.

Referring to FIGS. 1–3, the dry wall lift 10, consists of three basic elements. The first element is a vertical support assembly 12. Assembly 12 has a generally U-shaped support base 14. Support base 14 may measure approximately 2 feet along closed side 16, and approximately 2 feet along sides 18. A pair of female sockets 20 are integrally attached to the distal ends of sides 18 and are oriented at approximately right angles to base 14. Sockets 20 may extend vertically approximately 4 to 8 inches.

A pair of elongated parallel vertical members 22 engage sockets 20 in mating relationships. A pair of cross braces 26 are interposed between and rigidly interconnect vertical members 22. In addition, a lower horizontal bar 28 and an upper horizontal bar 30 are interposed between and rigidly attached to vertical members 22. Bar 28 is positioned just below sections 24, and upper horizontal brace 30 is located at the upper ends of vertical members 22.

The second element is a work frame 32 which consists of a pair of parallel side arms 34 which may be about 10 feet in length. Each of side arms 34 has a hooked end 35 so that supports arms 34 can be hooked onto the upper horizontal brace 30 for pivotal movement of work frame 32. A cross brace 36 extends between and is rigidly attached to side arms 34. A spacer 38 is rigidly attached to side arms 34 preferably about 8 feet from bent ends 35, and is oriented at right angles to side arms 34.

A hinge 40 is attached to the ends of side arms 34. A pair of legs 42 are hingedly coupled to support arms 34 by hinge 40. A pair of cross braces 44 extend between side arms 34 and legs 42 to maintain legs 42 at approximately right angles to side arms 34. Braces 44 are fastened to support arms 34 and legs 42 through conventional fasteners, so that braces 44 can be readily uncoupled for purposes hereinafter more fully set forth.

The third element consists of a stabilizing pole 46 which is attached to hinge 40 in such a way that stabilizing pole 46 may pivot about hinge 40 independent of legs 42.

In use, the dry wall lift apparatus is placed in a position approximately under the area where a sheet of dry wall is to be installed with hooked ends 35 of work frame 32 placed over upper horizontal brace 30 of vertical support 12. Vertical members 22 are of the proper height for a given ceiling . With work frame 32 in the lowered position A, see FIG. 2, work frame 32 forms an acute angle with vertical members 22. A sheet of dry wall is placed on work frame 32 so that the lower edge of the dry wall sheet abuts spacer 38. In lowered position A, stabilizing pole 46 is rotated to a position generally under work frame 32, and the lower end of work frame 32 is supported by legs 42. The work frame is then lifted through position B to the ceiling height position C. Stabilizing pole 46 is used to wedge the spacer 38 against the ceiling joists. Once accurately positioned, the sheet of dry wall can be nailed to the ceiling joists. The stabilizing pole is then released, the work frame lowered, and apparatus 10 would be repositioned for the placement of the next sheet of dry wall.

Lift apparatus 10 could also be used to support other materials overhead such as sections of duct work, ceiling beams, etc.

When working with dry wall, a horizontal working surface is frequently necessary. Accordingly, work frame 32 can be detached from upper horizontal brace 30, and hook ends of side arms 34 can be placed on the lower horizontal brace 28. As illustrated in FIG. 3, side arms 34 provide a horizontal working surface supported at hook ends by vertical support 12 and supported at the other end by legs 42.

Dry wall lift apparatus 10 is such that transportation and storage thereof requires very little space. To disassemble, work frame 32 is unhooked from vertical support 12. Cross braces 44 are uncoupled and legs 42 are rotated parallel to support arms 34. Thus, in its broken down form work frame 32 occupies a space of approximately 10 feet long and 2 feet wide. To disassemble vertical support 12, vertical members 22 are removed from female sockets 20. Disassembled and stacked together, the entire lift apparatus 10 can be transported or stored in a space approximately 10 feet long, 2½ feet wide, and 6 inches thick.

Vertical members 22 have been shown as fixed sections. It is understood that they may be formed as telescopic sections such that the vertical extension of members 22 can be varied. Variations to accommodate different ceiling heights may be from approximately 7 feet to approximately 9 feet. Telescopic sections can be provided with internal lock fasteners or other fastening systems conventionally used for telescoping sections.

Stabilizing pole 46 is shown as a solid pole. It is to be understood that it may be made telescopic such that the stabilizing pole 46 can be adjusted for varying ceiling heights. Telescoping sections may also be provided with suitable locks or fasteners not shown.

Having described the invention in connection with certain specific embodiments thereof, it is to be understood that further modifications may now suggest themselves to those skilled in the art, and it is intended to cover such modifications as fall within the scope of the appended claims.

I claim:

1. A dry wall panel lift with work frame comprising:

(a) a vertical support having spaced apart legs of about ceiling height and at least two crossbars, one at ceiling height and one at worktable height;

(b) a work frame having a pivotal detachable connection at one end thereof to one of said crossbars and having legs of worktable height at the other end thereof extending away from a work surface of said frame;

(c) a stiff leg pivotally connected to the end of said work frame opposite said connection and of length about equal ceiling height; and (d) a work stop extending across said work frame in the region remote from said connection whereby with one end of said work frame lowered to slope downwardly from said connection, said stop will support a ceiling panel on said work frame preparatory to elevating said panel to ceiling height, said work frame being connectable to either of said bars for selectively functioning as a ceiling panel lift or for a worktable support.

* * * * *